US010653222B2

(12) United States Patent
Scharnigg et al.

(10) Patent No.: US 10,653,222 B2
(45) Date of Patent: May 19, 2020

(54) CARD HOLDER

(71) Applicants: Rick Scharnigg, Amsterdam (NL); Olivier Momma, Amsterdam (NL); Richard Canneman, Amsterdam (NL)

(72) Inventors: Rick Scharnigg, Amsterdam (NL); Olivier Momma, Amsterdam (NL); Richard Canneman, Amsterdam (NL)

(73) Assignee: Rick Peter Gerard Scharnigg, Amsterdam (NL)

( * ) Notice: Subject to any disclaimer, the term of this patent is extended or adjusted under 35 U.S.C. 154(b) by 192 days.

(21) Appl. No.: 15/980,773

(22) Filed: May 16, 2018

(65) Prior Publication Data

US 2018/0338593 A1 Nov. 29, 2018

Related U.S. Application Data

(60) Provisional application No. 62/509,868, filed on May 23, 2017.

(51) Int. Cl.
*A45C 11/18* (2006.01)
*B65D 83/08* (2006.01)

(52) U.S. Cl.
CPC ..... *A45C 11/182* (2013.01); *B65D 83/08* (2013.01)

(58) Field of Classification Search
CPC ..... A45C 11/182; B65D 83/08
See application file for complete search history.

(56) References Cited

U.S. PATENT DOCUMENTS

| | | | | |
|---|---|---|---|---|
| 4,852,727 | A * | 8/1989 | Oberle | A45C 11/182 206/39.4 |
| 4,934,520 | A * | 6/1990 | Okada | A45C 11/18 150/134 |
| 5,125,505 | A * | 6/1992 | Kurosaki | A45C 11/182 206/38 |
| 6,412,627 | B1 * | 7/2002 | Tiscione | A45C 11/182 150/147 |
| 7,267,147 | B2 * | 9/2007 | Tiscione | A45C 11/182 150/147 |
| 9,339,094 | B2 * | 5/2016 | Tucker-Skow | A45C 11/182 |
| 9,661,116 | B1 * | 5/2017 | Chung | A45C 11/00 |
| 9,907,375 | B1 * | 3/2018 | Kitchen | A45C 11/182 |
| 10,178,901 | B2 * | 1/2019 | Chan | A45C 11/182 |
| 10,278,466 | B2 * | 5/2019 | Talarico | A45C 11/182 |
| 10,306,963 | B2 * | 6/2019 | Van Geer | A45C 11/182 |
| 10,511,342 | B1 * | 12/2019 | Chung | A45C 11/182 |
| 2014/0014676 | A1 * | 1/2014 | Minson | B65D 83/0829 221/226 |

* cited by examiner

*Primary Examiner* — Tri M Mai

(57) ABSTRACT

A card holder is provided. The card holder comprises a first housing and a second housing conjoined to form a casing for stacking one or more cards. The first housing comprises an ejector assembly comprising a sliding member, a spring, and a stair assembly. The sliding member comprises a force applying region adapted to receive an external force for causing a sliding movement of the sliding member within the first housing. The sliding member further comprises a shaft. An end of the spring is wounded on the shaft and another end of the spring is stacked against a wall of the first housing. The stair assembly is adapted to be moveably connected to the sliding member. In response to the sliding movement, the stair assembly rotates along an axis in an anticlockwise direction to cause partial ejection of the one or more cards out of the casing in a tiered arrangement.

11 Claims, 6 Drawing Sheets

CARD HOLDER

CROSS-REFERENCE TO RELATED APPLICATION

The present application claims the priority benefits of U.S. Provisional Application No. 62/509,868, filed on May 23, 2017, which is incorporated herein by reference in its entirety.

FIELD OF INVENTION

The present disclosure relates to card holders. More particularly, the present invention relates to a card holder that securely holds one or more bank cards, and various other cards of approximately the same size and width like the bank cards and is capable of auto ejecting the cards out of the holder in a tiered fashion.

BACKGROUND

Standard wallets or purses contain several pockets for storing the paper money, coins, various cards such as credit and/or debit cards. Some wallets do have clear plastic envelopes that serve to store the cards and help the users organize their cards. Although conventionally, such wallets or purses have been used for storing the cards, such wallets or purses are not ideal for several reasons. Firstly, it is very difficult to place into or retrieve the cards from deep pockets or plastic envelopes that such conventional wallets or purses possess. Secondly, due to lack in space available for individual cards, we normally need to store a stack of multiple cards in a single pocket or envelope due to which retrieval of a particular desired card is very time consuming because all cards in the stack need to be at least partially removed or displaced for sorting and picking out the desired card. Again, when we are in urgency, there is a risk that the cards can fall out of the pockets of such wallets or purses when we are sorting through the stack of the cards in the pocket to find the desired card.

One of the existing card holders, as disclosed in EP 0287532 partially ejects the cards out of the card holder. The holder dispenses the cards from the holder by sliding in relation to one another in a tiered fashion. As explained in the patent document, the cards stored within the holder are pushed out by using a hinged lever which is interlinked to a hinged element. It is also disclosed that the card holder includes a lid and two flexible strips (with each strip embodying two bulges) applied in symmetrical fashion to the inside faces of the two sides of the holder that prevents cards from prematurely leaving the holder.

Many other attempts have been made in the past, and several automatic card holders are made available to facilitate storing, and auto ejection of the cards out of the card holder. However, such arts seem to have either complex ejection mechanism involved for ejection of the cards out of the holder, or seem carrying risk of cards falling out of the holder during the ejection. In some of the card holders, it is found one or more cards are jammed in between the ejection assembly and the walls of the card holder case due to erroneous performance of the ejection assembly, when the ejection assembly tries to eject the cards out of the holder or the user pushes the cards inside the holder.

Thus, there is a need to alleviate drawbacks associated with conventional card holders. There is also a need to address the demand of users that often need to carry different types of cards with them and often need to use those cards at several locations, like retail stores, banks. Further, there is a need of a card holder that would facilitate problem-free dispensing of the cards out of the holder using simple and more reliable ejection mechanism and frictional element that would effectively control accidental ejection of the cards out of the card holder and that would consistently provide frictional force over a long run.

SUMMARY

It is an object of the present invention to provide a card holder, which completely encloses the cards held in it in a stacked form and facilitate smooth dispensing of the cards out of the holder using a simple and more reliable ejection assembly as will be described in the current disclosure.

It is another object of the present invention to provide a card holder that dispenses all the cards held inside the holder, all at once, in a tiered form so the user can visually pick up the desired card without having to go through the time consuming process of sorting the cards to pick the desired card out.

It is another object of the present invention to provide a card holder and dispenser with an ejection assembly integrated in a way to make overall size of the holder more compact and portable to carry.

It is another object of the present invention to provide a card holder with improved ejection mechanism and frictional element which may be relatively easy and cheap to manufacture.

It is yet another object of the present invention to provide a card holder capable of holding and dispensing multiple cards with varied thickness with less risk of jamming of cards between the ejection assembly and the top and bottom walls of the card holder.

According to an aspect of the present invention, a card holder is provided. In an example, the card holder comprises a first housing and a second housing conjoined to form a casing for stacking one or more cards. The first housing comprises an ejector assembly. The ejector assembly comprises a sliding member, a spring, and a stair assembly. The sliding member comprises a force applying region adapted to receive an external force for causing a sliding movement of the sliding member within the first housing. The sliding member further comprises a shaft. An end of the spring is wounded on the shaft and another end of the spring is stacked against a wall of the first housing. The stair assembly is adapted to be moveably connected to the sliding member. In response to the sliding movement of the sliding member, the stair assembly rotates along an axis in an anticlockwise direction to cause partial ejection of the one or more cards out of the casing in a tiered arrangement.

According to further aspects, the card holder further comprises at least one frictional element disposed along at least one side wall of the second housing for providing frictional resistance to the one or more cards during the partial ejection of the one or more cards from the card holder.

According to further aspects, the ejector assembly further comprises a spacer disposed in between the sliding member and the stair assembly.

According to further aspects, the stair assembly comprises a stepping member and a base member. The stepping member comprises a flight of steps and an arm. The arm is provided with a slot. The base member comprises a body portion and an arm portion. The body portion supports the stepping member. The arm portion comprises a first pivot for connecting the stepping member to the base member using the slot and, for further connecting the stair assembly to the first housing. The arm portion comprises a second pivot for operably connecting the stair assembly to the sliding member.

According to further aspects, the sliding member further comprises a recess for receiving the arm portion such that the second pivot operationally fits into the recess, where the recess comprises a protrusion tip extending outwards from the sliding member and towards the second housing, and where the protrusion tip is adapted to provide support to the stair assembly during the partial ejection of the one or more cards from the casing.

According to further aspects, the second housing comprises of a bottom wall, a top wall and two lateral walls or side walls, where the bottom wall, the top wall and the two lateral walls are conjoined to form an enclosure having an opening for housing the one or more cards therein, such that the an edge of each of the one or more cards is supported by the steps of flight.

According to further aspects, the first housing and the second housing are connected to each other using a snap-fit mechanism.

According to further aspects, the first housing and the second housing are connected to each other using at least one fastening means.

According to further aspects, the stair assembly is made of plastic material.

Additional objects, features and aspects of the present invention would appear and become clear as the detail description proceeds with the accompanying drawings.

BRIEF DESCRIPTION OF THE ACCOMPANYING DRAWINGS

The novel features which are believed to be characteristic of the present disclosure, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this disclosure will now be described by way of example in association with the accompanying drawings in which:

DETAILED DESCRIPTION

The terminology used in the present disclosure is for the purpose of describing exemplary embodiments and is not intended to be limiting. The terms "comprises," "comprising," "including," and "having," are inclusive and therefore specify the presence of stated features, operations, elements, and/or components, but do not exclude the presence other features, operations, elements, and/or components thereof.

In an event an element is referred to as being "on", "engaged to", "connected to" or "coupled to" or "attached to" another element, it may be directly on, engaged, connected or coupled to the other element, or intervening elements may be present. On the contrary, in an event an element is referred to as being "directly on," "directly engaged to", "directly connected to" or "directly coupled to" another element, there may be no intervening elements present. Other words used to describe the relationship between elements should be interpreted in a similar fashion. Further, the term "and/or" includes any and all combinations of one or more of the associated listed items.

Unlike conventional card holders, proposed card holder employs an ejection assembly activated just by a simple push of an ejector button. The activation or a push of the ejector button pushes the cards held inside the card holder to eject out in a tiered fashion. Although, the current embodiment and related illustrations shows maximum of six cards held inside the holder, it should be understood by those skilled in the art that the holder may be designed for a varied number of cards that can be housed inside the holder. The accompanying drawings FIGS. 1-5 described hereinafter will describe the components, and functionality of the proposed invention in greater detail.

Figure 1A:
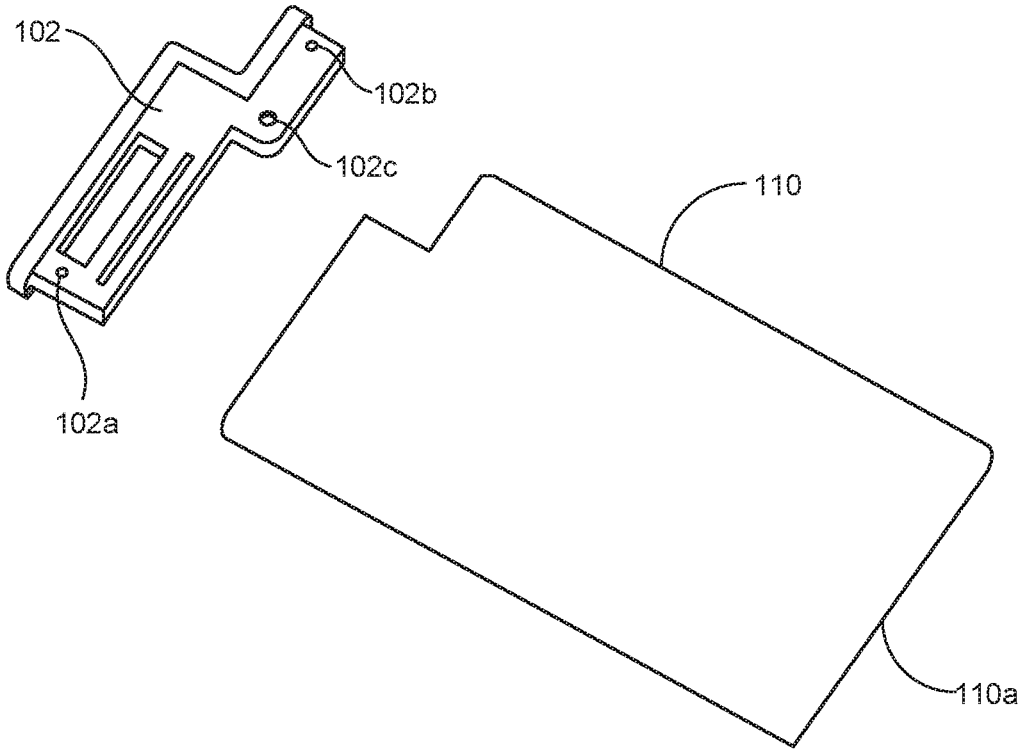
FIG. 1A-1B illustrates an exploded view and an assembled view of an outer case assembly of a card holder of the present invention, in accordance with an embodiment of the present disclosure.
Figure 1B:
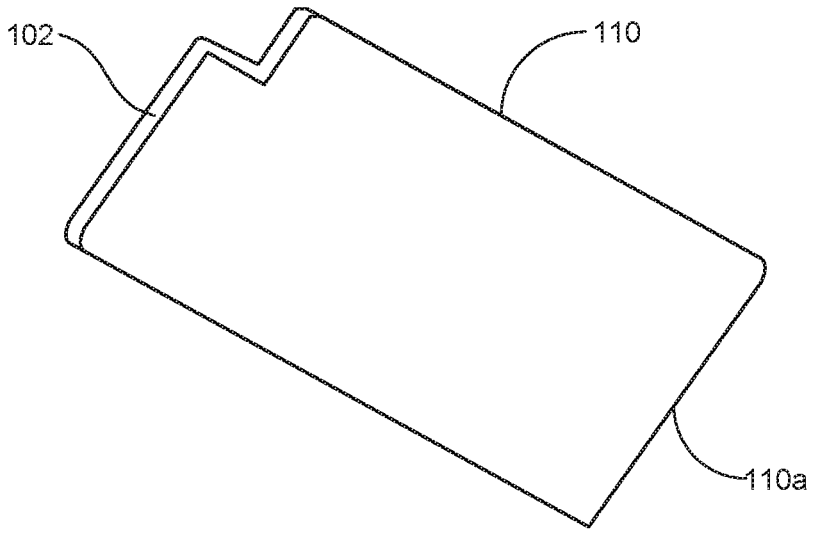

FIG. 1A-1B illustrates an exploded and an assembled view, respectively, of a casing of a card holder of the present invention.

Referring to FIGS. 1A and 1B, the card holder includes a casing. The casing is composed of a first housing (102) and a second housing (110). According to an embodiment, the second housing (110) mates or engages with the first housing (102) by a snap fit mechanism. In another embodiment, the second housing (110) mates or engages with the first housing (102) using fastening means such as screws passing through openings (102*a*,102*b*) provided over the second housing (110) and the first housing (102). In an embodiment, the second housing (110) comprises of a top wall, a bottom wall and two lateral walls or side walls conjoint to form the housing (110). The four walls conjoined to form an enclosure having an opening (110*a*) for housing the one or more cards therein. Through the opening (110*a*), one or more cards may be placed into or ejected from the card holder.

Figure 2:
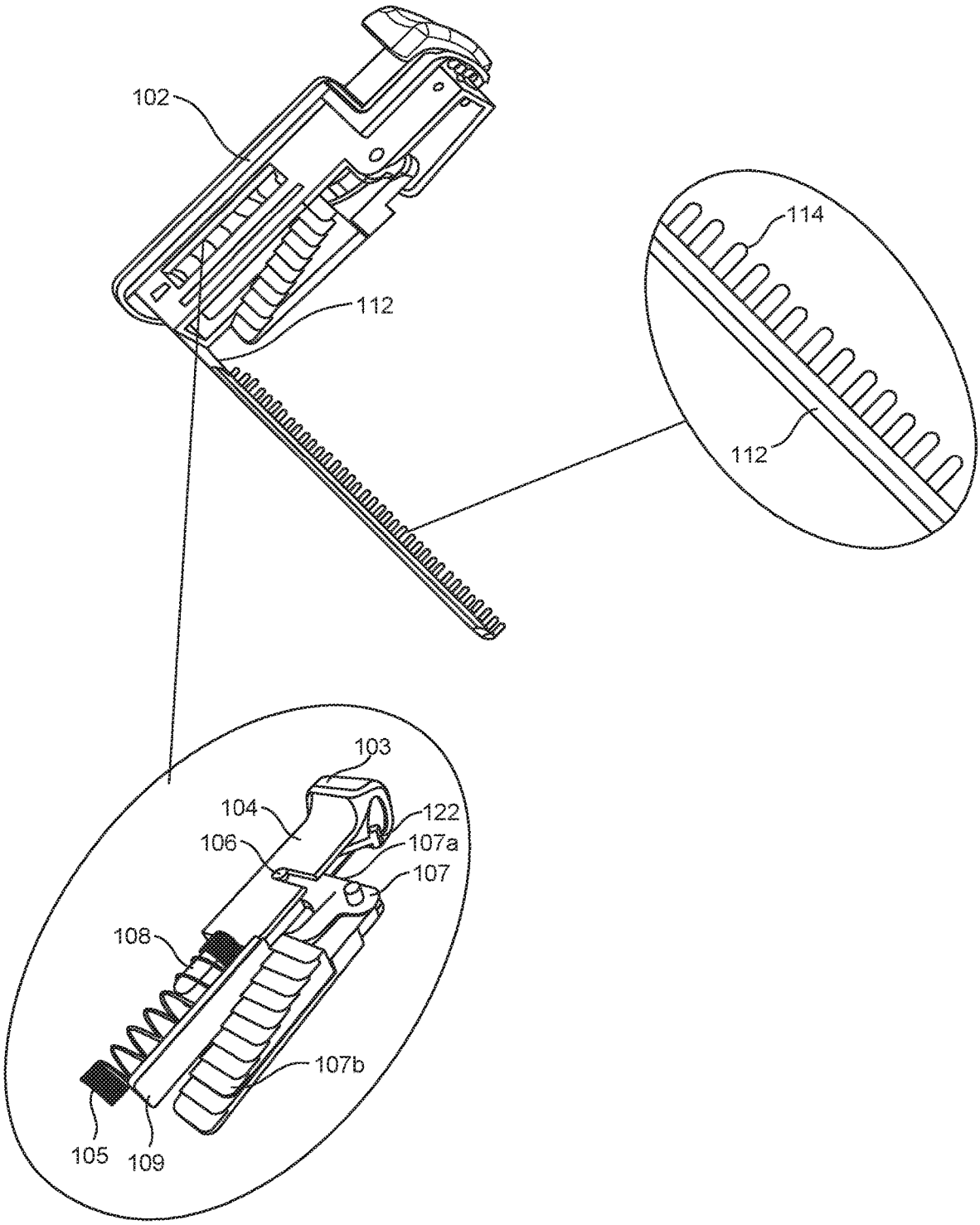
FIG. 2 shows a detailed view of the card holder with a first housing, and a friction element, in accordance with an embodiment of the present disclosure.

FIG. 2 shows a detailed view of the card holder with the first housing (102), an ejector assembly, and at least one friction element (112,114). As may be noted, for the sake of brevity, the second housing (110) and the stack of cards (120) are not shown in the figure. Further, for the sake of brevity, components pertaining to the ejector assembly and at least one friction element (112,114) have been shown in a magnified view.

In an example, the ejector assembly comprises a sliding member (104), a spring (105), and a stair assembly (107). The sliding member (104) includes a force applying region (103) adapted to receive an external force for causing a sliding movement of the sliding member (104) within the first housing (102). The force applying region (103) is hereinafter interchangeably referred to as ejector button (103). The sliding member (104) further includes a shaft (108) protruding inward from a bottom end of the sliding member (104) and operationally coupling to the spring (105) as shown in the figure. In an example, an end of the spring (105) is wounded on the shaft (108) and another end of the spring (105) is stacked against a wall of the first housing (102). The spring (105) precisely fit around the shaft (108)

to enable the ejector button (103) to retain its original position or bounce back to its original position once the user releases the thumb from the ejector button (103) after activating the ejection assembly. The ejection assembly may further include a spacer (109) disposed in between the sliding member (104) and the stair assembly (107).

Figure 4A:
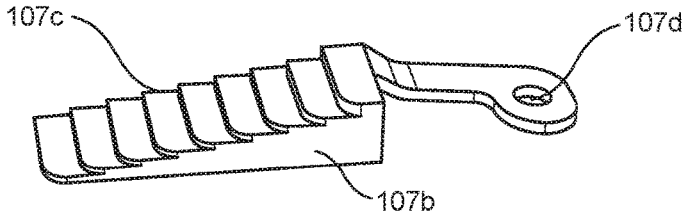
FIG. 4A-4C shows a stair assembly, in accordance with an embodiment of the present disclosure.
Figure 4B:
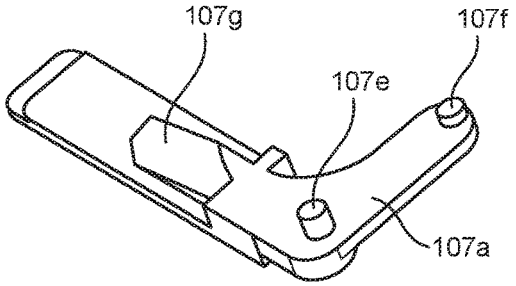
Figure 4C:
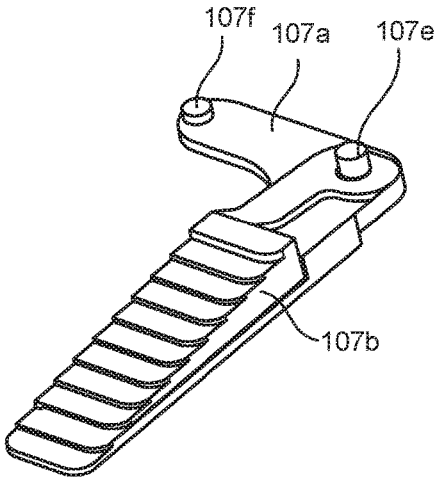

Further description of FIG. 2 will now be described in conjunction with FIGS. 4A-4C. Referring to FIGS. 4A-4C, the stair assembly (107) comprises of a stepping member (107*b*) with a flight of steps (107*c*) and an arm with a slot (107*d*). As shown, each of the steps of the flight of steps (107*c*) are substantially spaced apart from each other to precisely hold the cards (120). In an example, based on the design requirement, the number of steps present in the flight of steps (107*c*) may differ. Further, based on the number of steps, the number of cards (120) that can be held inside the card holder for effective operation may be determined. The stair assembly (107) further comprises a base member (107*a*) with a body portion (107*g*), and an arm. The arm comprises a first pivot (107*e*) and a second pivot (107*f*). The first pivot (107*e*) is used for connecting the stepping member (107*b*) to the base member (107*a*) using the slot (107*d*) and, for further connecting the stair assembly (107) to the first housing (102).

Further, as shown, the stepping member (107*b*) is configured/designed such as to enable the stepping member (107*b*) to properly and tightly mate with the body portion (107*g*) of the base member (107*a*) with the pivot (107*e*) engaging the slot (107*d*). According to the embodiment of the present invention, the stair assembly (107) comprising of two piece components, namely the stepping member (107*b*) and the base member (107*a*) provide tolerance towards jamming of one or more cards, while the card holder is in operation. Further, the arm with the pivot (107*f*) of the base member (107*a*) is configured such as to operationally fit into a recess (106) of the sliding member (104) such as to enable the rotation of the stair assembly (107) when the ejection button (103) is actuated for dispensing the cards (120) out of the card holder. The pivot (1070 acts as a rotational axis for the stair assembly (107). It should be understood that, when the arm of the base member (107*a*) engages into the recess (106), the pivot (107*e*) engages to the slot (102*c*) (as shown in FIG. 1A) provided on the first housing (102). In an example, the stair assembly (107) may preferably be made of, but not limited to, plastic material or other such similar material.

In an example, the recess further comprises a protrusion tip (122) extending outwards from the sliding member (104) and towards the second housing (110). In an example, the protrusion tip (122) is adapted to provide stability or support to the stair assembly (107) during the partial ejection of the one or more cards (120) from the casing. The protrusion tip (122) further serves to lower vibration of the casing, when the card holder is in use.

Further Referring to FIG. 2, the friction element (112,114) is configured on at least one lateral wall of the second case (110) along the longitudinal axis. In an example, the frictional element (112,114) is configured to frictionally engage with sides of the cards (120) to control accidental ejection of the cards out of the holder (100) on activation of the ejector button (103). In an embodiment, the friction element (112, 114) comprises a base plate (112) and a top resilient part (114). The top resilient part (114) is parallelly and removably configurable over the base plate (112) using suitable fastening means like screws which may be inserted and locked within the slots (not shown) provided onto the base plate (112). Further, according to the embodiment of the present invention, the resilient part (114) may be parallelly and fixedly attached onto the base plate (112) using direct injection molding or by using some adhesive means, for example glue.

In an embodiment, the resilient part (114) may preferably be made of silicon rubber for durability which can provide consistent frictional force over a long run. As will be apparent to those skilled in the art, any other substitute material can also be used which doesn't wear off fast and is able to provide consistent frictional force to the cards (120) when they are ejected out of the holder (100). Further, according to the embodiment, the base plate (112) may be made of any suitable rigid material preferably including but not limited to steel. Further as seen, the top surface of the resilient part (114) engaging the cards (120) may comprise of a plurality of the protruding elements dispersed over the surface in a predefined pattern. In an example, the plurality of the protruding elements may be provided in the form of small dents.

Figure 3A:
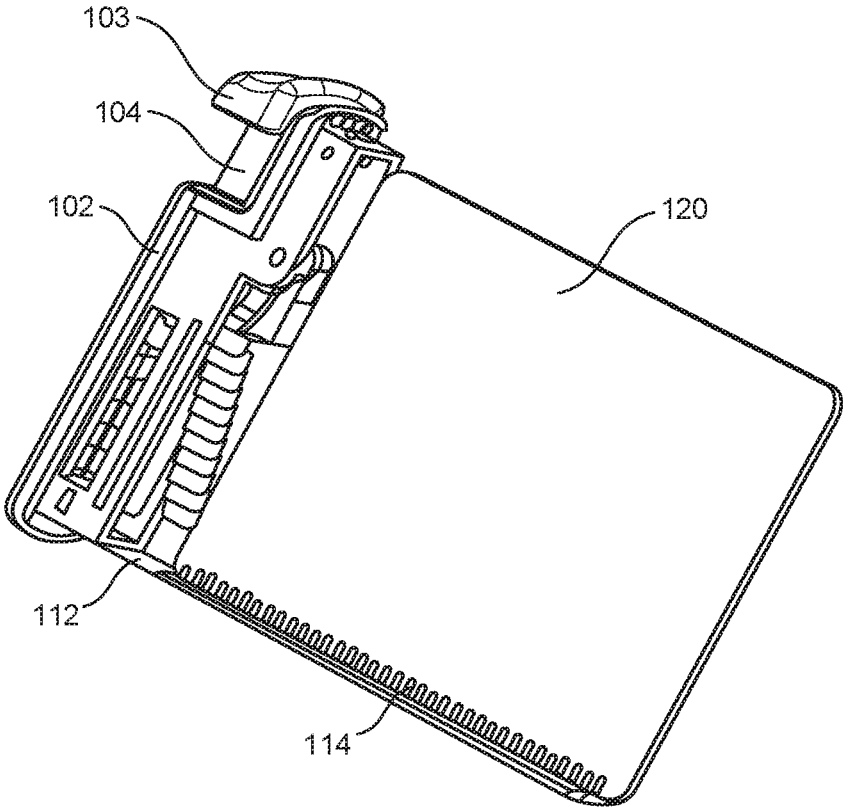
FIG. 3A-3B shows a detailed view of the card holder of FIG. 2 with one or more cards stored therein, in accordance with an embodiment of the present disclosure.
Figure 3B:
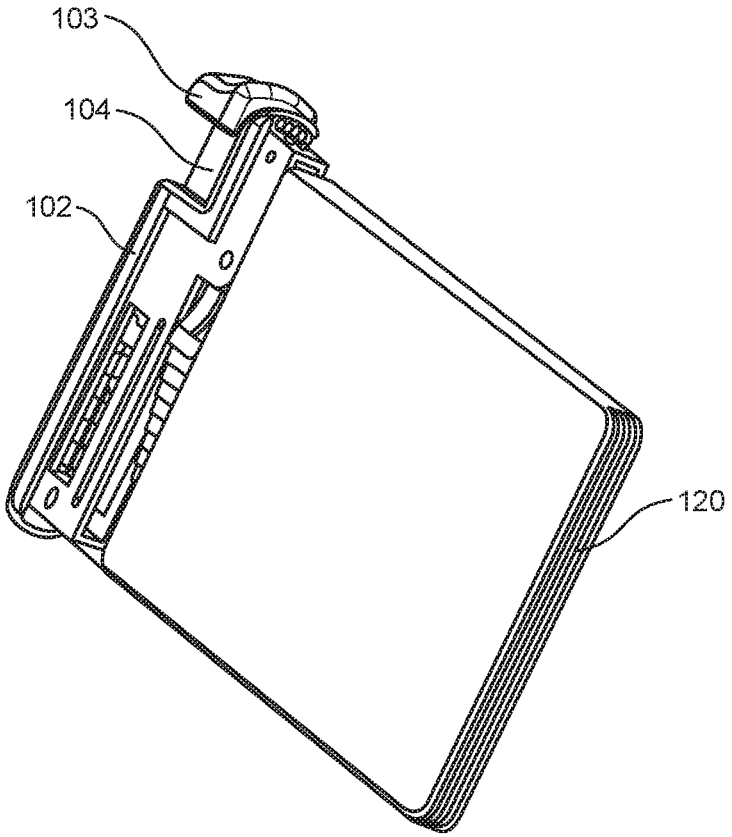

Referring to FIGS. 3A-3B detailed view of the card holder without the second housing (110) with one or more cards stored therein is shown. In particular, FIG. 3A and FIG. 3B illustrates one single card and six cards, respectively, held inside the card holder (100). As can be further seen, the cards are aligned with the stair assembly (107) and the frictional element (112,114). Although it is illustrated that the second housing (not shown) securely holds maximum of six cards in the stacked form, it should be understood that at least one card may be held inside the card holder (100) for the functioning of the card holder (100). Examples of the cards (120) may include, but are not limited to, bank cards, such as a credit card, a debit card, an ATM card, a grid authentication card, and a driving license, and an identity card of approximately the same size and width such as that of the bank cards.

Figure 5:
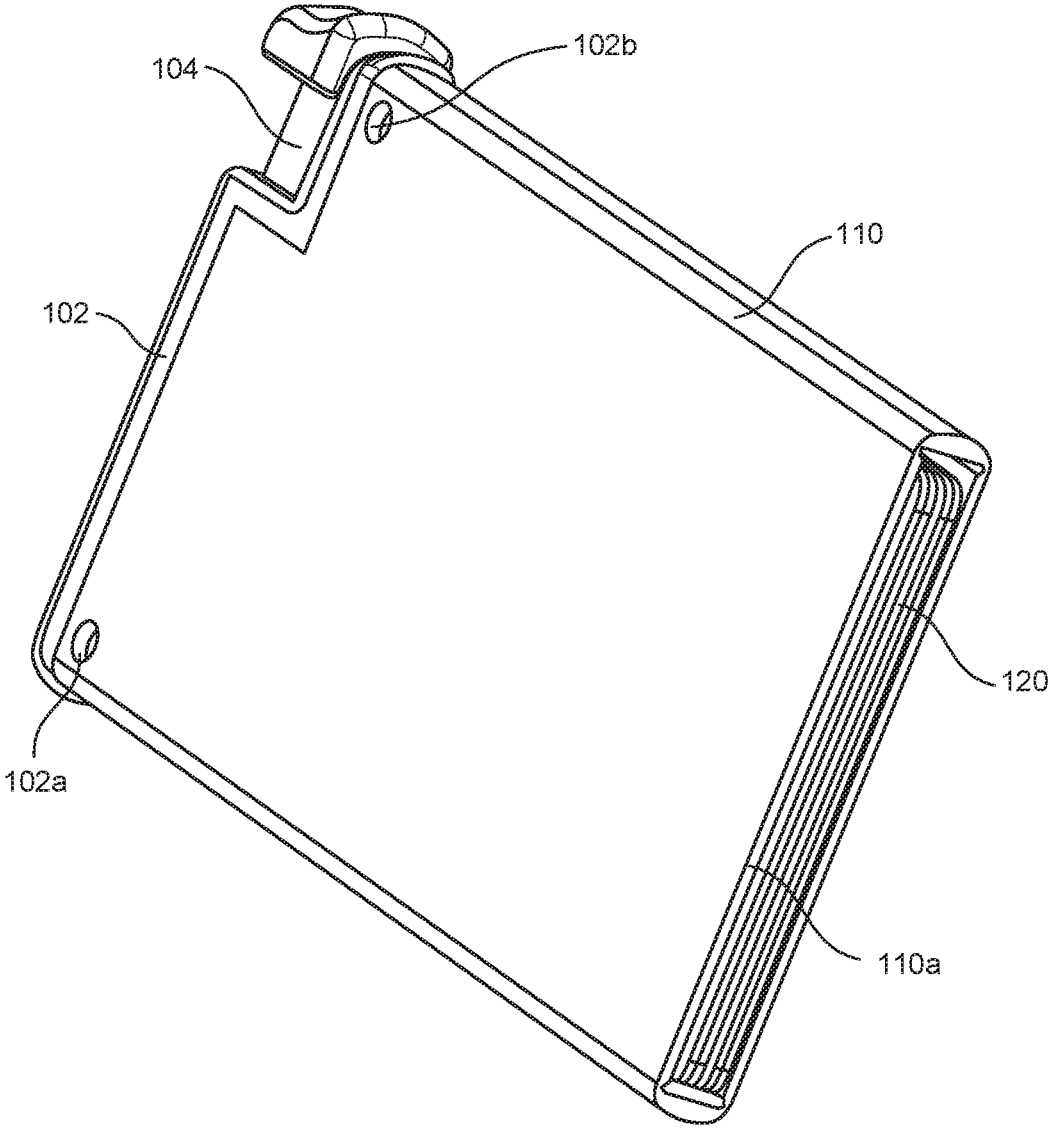
FIG. 5 shows the card holder with cards stored therein, according to an embodiment of the present invention.

Referring now to FIG. 5 the card holder with cards stored therein is shown. Assuming the card holder (100) holds a stack of six cards (120), the method of operation will now be described.

In operation, a user may operate the ejection assembly of the holder (100) by pushing the ejector button (103) using his thumb. The push of the ejector button (103) pushes the sliding member (104) and thus compresses the spring (105). The displacement of the spring (105) from a relaxed position to a tension position against the wall of the first surface (102) causes the stair assembly (107) to rotate about the pivotal axis/rotational axis about the pivot (1070. In an example, the rotation may be in an anti-clockwise direction in a predetermined angle sufficient to eject the cards (120) out of the holder (100) in a tiered arrangement owing to the flight of steps. As the stair assembly (107) makes a rotational movement in the anticlockwise direction along an axis, the cards (120) held inside the second housing (110) aligned with the stair assembly (107) emerge out through the opening (110*a*) of the second housing (110) in the tiered arrangement. The spring (105) precisely fitted around the shaft (108) enables the ejector button (103) and the sliding member (104) to gain its original position upon release of the thumb from the ejector button (103).

Once the cards (120) are ejected out of the holder (100), the user can choose the desired card and transact or use the card as needed. Thereafter, the user can push back the ejected cards inside the holder (100) again. When the user pushes back the ejected cards into the holder (100), the cards (120) are stored in the stacked form again. During the operation, the frictional element (112,114) that frictionally engages to the sides of the card (120) ensures that the cards (120) do not suddenly fall out of the holder (100) when the ejector ejection assembly is pushing the cards (120) out of the holder (100).

Although, the card holder and ejector mechanism described above dispenses card specially bank cards or the like cards but can also be used to dispense different other items. For example, it can be used to dispense glass slides for medical purposes, and for many other purposes like for dispensing the CDs, SD/SIM cards, business cards, playing cards with just some small dimensional changes as will be apparent to those skilled in the art. Furthermore, the card holder and ejector mechanism and associated components described above may be made of plastic (possibly PVC), aluminum or any like material as will be apparent to those skilled in the art.

We claim:

1. A card holder, comprising:

a first housing and a second housing conjoined to form a casing for stacking one or more cards, the first housing comprising an ejector assembly, the ejector assembly comprising:

a sliding member comprising;

a force applying region adapted to receive an external force for causing a sliding movement of the sliding member within the first housing; and a shaft; and a spring, wherein an end of the spring is wounded on the shaft and another end of the spring is stacked against a wall of the first housing; and a stair assembly adapted to be moveably connected to the sliding member, wherein, in response to the sliding movement of the sliding member, the stair assembly rotates along an axis in an anticlockwise direction to cause partial ejection of the one or more cards out of the casing in a tiered arrangement.

2. The card holder as claimed in claim 1, wherein the stair assembly comprises:

a stepping member comprising a flight of steps and an arm, wherein the arm is provided with a slot; and a base member comprising:

a body portion for supporting the stepping member; and an arm portion comprising:

a first pivot for connecting the stepping member to the base member using the slot and, for further connecting the stair assembly to the first housing; and a second pivot for operably connecting the stair assembly to the sliding member.

3. The card holder as claimed in claim 2, wherein the stair assembly comprising of the stepping member, and the base member provide tolerance towards jamming of one or more cards, while the card holder is in operation.

4. The card holder as claimed in claim 1, wherein the sliding member further comprises a recess for receiving the arm portion such that the second pivot operationally fits into the recess, wherein the recess comprises a protrusion tip extending outwards from the sliding member and towards the second housing, and wherein the protrusion tip is adapted to provide stability to the stair assembly during the partial ejection of the one or more cards from the casing.

5. The card holder as claimed in claim 1, wherein the second housing comprises a bottom wall, a top wall and two lateral walls, wherein the bottom wall, the bottom wall and the two lateral walls are conjoined to form an enclosure having an opening for housing the one or more cards therein, such that the an edge of each of the one or more cards is supported by the flight of steps.

6. The card holder as claimed in claim 1, further comprising at least one frictional element disposed along at least one side wall of the second housing for providing frictional resistance to the one or more cards during the partial ejection of the one or more cards from the card holder.

7. The card holder as claimed in claim 6, wherein the at least one frictional element comprises a base plate and a resilient part.

8. The card holder as claimed in claim 1, wherein the ejector assembly further comprises a spacer disposed in between the sliding member and the stair assembly.

9. The card holder as claimed in claim 1, wherein the first housing and the second housing are connected to each other using a snap-fit mechanism.

10. The card holder as claimed in claim 1, wherein the first housing and the second housing are connected to each other using at least one fastening means.

11. The card holder as claimed in claim 1, wherein the stair assembly is made of plastic material.

* * * * *